US005393254A

United States Patent [19]

Ducheshe

[11] Patent Number: 5,393,254

[45] Date of Patent: Feb. 28, 1995

[54] LIFESAVING APPARATUS

[76] Inventor: Claude A. Ducheshe, 1051 Via Cordova, San Pedro, Calif. 90731

[21] Appl. No.: 270,474

[22] Filed: Jul. 5, 1994

[51] Int. Cl.[6] ..... B63C 9/08

[52] U.S. Cl. ..... 441/118; 441/108

[58] Field of Search ..... 441/88, 92, 93, 94, 441/96, 99, 102, 106, 111, 112, 113, 114–119

[56] References Cited

U.S. PATENT DOCUMENTS 2,774,979 12/1956 Moran ..... 441/94
2,784,426 3/1957 Boyle et al. ..... 441/111
4,673,366 6/1987 Hawkins ..... 441/118

*Primary Examiner*—Jesus D. Sotelo
*Attorney, Agent, or Firm*—Matthew P. Lynch

[57] ABSTRACT

A lifesaving apparatus for a human in the form of a waist pack adapted to be worn about the waist of a human. The waist pack has an inflatable vest located therein in a non-inflated/collapsed position. The opening into the interior chamber of the waist pack, where the vest is located, is normally closed by a flap. Extending exteriorly of the waist pack is a manually movable handle. Sufficient manual movement of the handle will cause the vest to inflate, open the flap with the vest being located exteriorly of the pack to then be placed about the head of the human.

5 Claims, 1 Drawing Sheet

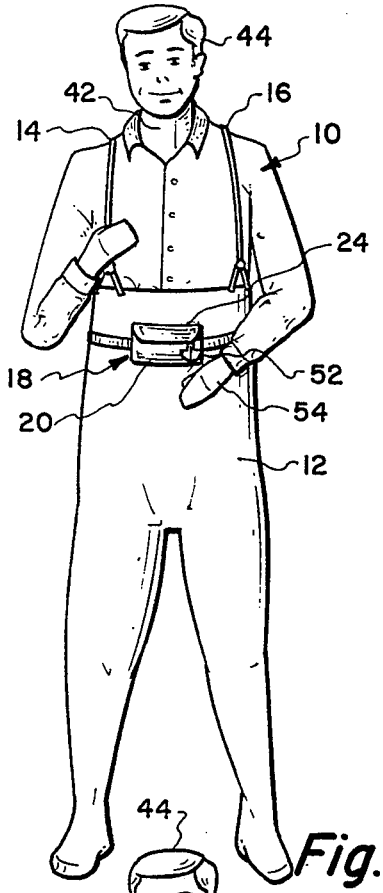
Fig. 2.
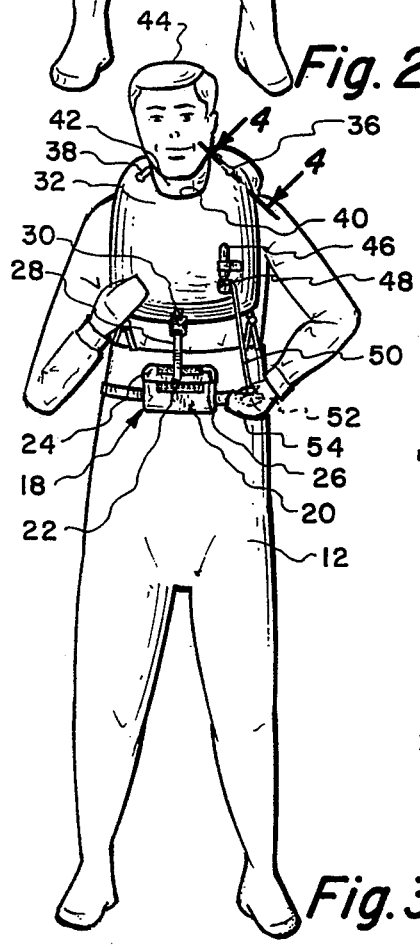
Fig. 3
Fig. 1.
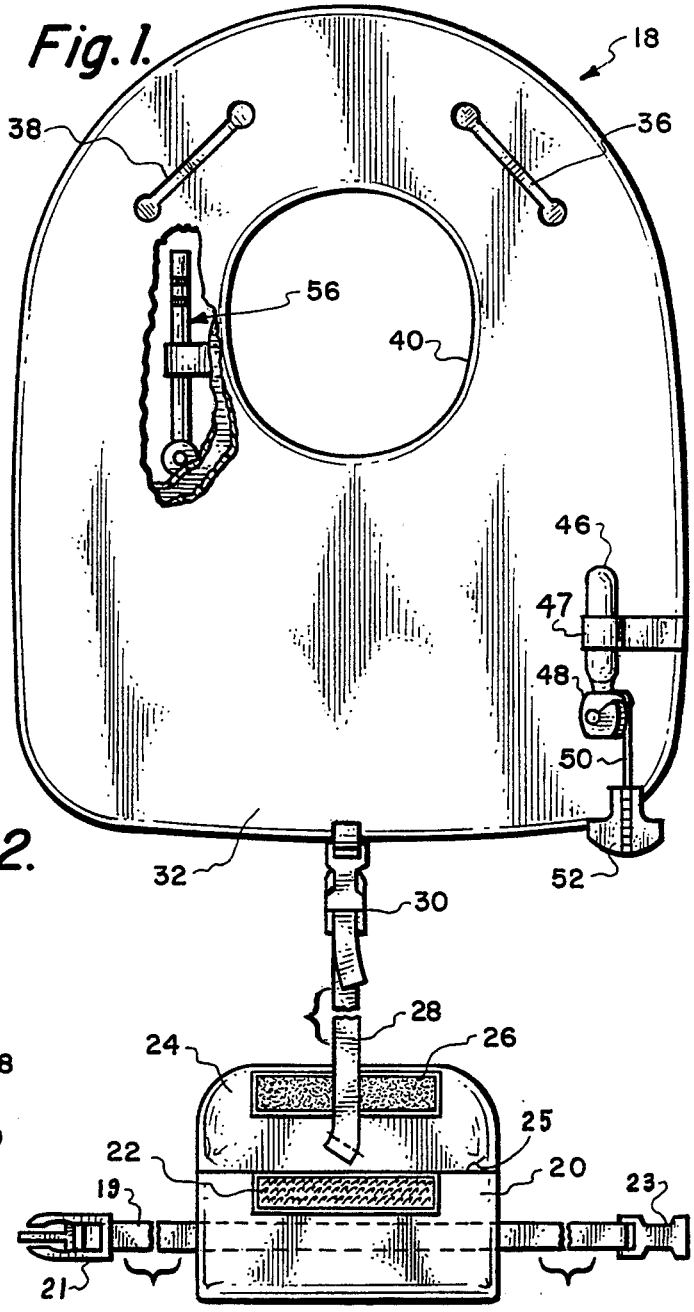
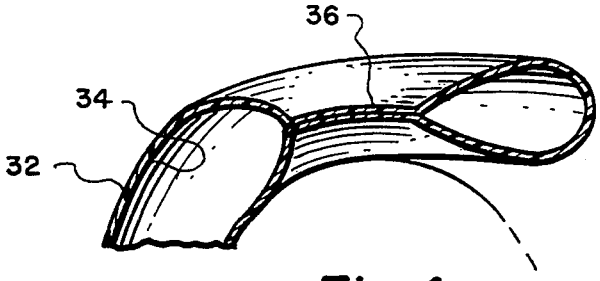
Fig. 4.

LIFESAVING APPARATUS

BACKGROUND OF THE INVENTION

1. Field of the Invention

The field of this invention is directed to a human lifesaving apparatus in the form of a waist pack which contains an inflatable vest which can then be utilized as a floatation device for the human in water.

2. Description of the Prior Art

Inflatable life vests have long been utilized as flotation devices for humans. There are a great many sporting activities that are engaged in by humans in conjunction with water. These water activities can prove to be unexpectedly dangerous and have been known to cause the death of the participant. One such activity is fishing where the fisherman uses a wader. A wader is a waterproof garment that extends from the feet of the user over the waist of the user. The wader is used by the fisherman when walking within streams, ponds and lakes when fishing.

During fishing there are times where the fisherman could step into a hole or drop-off that is of a depth greater than the height of the fisherman. This causes the water to enter through the top of the wader with the net result that the fisherman is no longer buoyant and the fisherman sinks to the bottom of the hole or drop-off. The result is the fisherman drowns. To overcome this in the past, the only option has been for the fisherman to wear a lifesaving vest of some sort. The only problem with this is the continuous wearing of such a lifesaving device hampers movement of the fisherman. Fisherman like to be free to move so as to smoothly and accurately cast a fishing rod. Also the continuous wearing of a life vest can be hot to the human.

There is a need to make available to a fisherman a life-saving vest when the fisherman finds himself or herself in a dangerous situation while at the same time eliminating continuous wearing of the lifesaving vest during the time that it is not needed.

SUMMARY OF THE INVENTION

The structure of the present invention is directed to a waist pack which is normally worn by means of a belt about the waist area of a human. The waist pack includes an interior compartment. An inflatable life vest in a non-inflated/collapsed position is to be located within the interior compartment. Between the life vest and the waist pack there is connected a strap with a buckle being associated with this strap in order to facilitate adjusting movement of the vest relative to the waist pack so as to accommodate the different sizes of humans. The interior compartment of the waist pack is normally closed by a flap with a disengageable fastener normally holding the flap in a closed position. A manually engageable handle extends exteriorly of the interior compartment and the waist pack and when sufficiently moved, activates a supply of gas from a tank source mounted on the life vest to cause the vest to be inflated. The inflation movement of the life vest will cause the fastener of the flap to be disengaged and the flap moved to an open position and the vest moved exteriorly of the interior compartment. The vest includes an interior enlarged opening through which the head of the user is to be located, placing the vest on the shoulders and chest area of the user, with the vest now functioning as a buoyant device to cause the human to float.

The primary objective of the present invention is to construct an apparatus which can save the life of a human being that is about ready to drown.

Another objective of the present invention is to construct a lifesaving apparatus that is worn by a human with the apparatus being in an inactive state and, upon the human incurring a dangerous condition, the human can cause the device to be immediately activated, making it available as a lifesaving device.

Another objective of the present invention is to construct a lifesaving device which can be manufactured relatively inexpensively and therefore sold to the ultimate consumer at a relatively inexpensive price.

BRIEF DESCRIPTION OF THE DRAWING

FIG. 1 is an overall view of the apparatus of the present invention in its usage position with the vest being displaced from the interior compartment of the waist pack;

FIG. 2 is a front view of a typical user upon which the waist pack lifesaving apparatus of the present invention is worn about the waist of the human with the apparatus in its inactive configuration;

FIG. 3 is a view similar to FIG. 2, but showing the apparatus installed in its active position which is to be used as a lifesaving apparatus; and FIG. 4 is a cross-sectional view through a portion of the life vest taken along line 4—4 of FIG. 3.

DETAILED DESCRIPTION OF THE SHOWN EMBODIMENT

Referring particularly to the drawing there is shown in FIGS. 2 and 3 a human 10 wearing a pair of waders 12. The waders 12 are supported on the shoulders of the human 10 by straps 14 and 16. The apparatus 18 of this invention includes a waist belt 19, the ends of which are to be connectable together in a secure manner by means of a female buckle 21 and a male buckle 23. The apparatus 18 is to be snugly mounted about the waist area of the human 10 and also about the upper end of the waders 12.

The apparatus 18 includes a waist pack 20. The waist pack 20 comprises a flexible wall, generally constructed of a plastic or fabric type of container which has an interior compartment 25 in the form of a pocket. This waist pack 20 includes a flap 24. It is the function of the flap 24 to be open as shown in FIG. 1 so as to permit access into and out of the interior compartment 25, or to be closed as is shown in FIG. 2 which permits access into and out of the compartment 25. Mounted on the inside of flap 24 is a strip 26 of a mass of tiny eyelets which are to connect with strip 22 composed of a mass of tiny hooks. The strip 22 is fixedly mounted on the exterior wall surface of the waist pack 20. The connection between the strips 22 and 26 constitute a releasable fastener which functions to retain the flap 24 in a closed position, The strips 22 and 26 are deemed to be conventional and commonly sold under the trade name of VELCRO.

Fixedly connected to the inside of flap 24 is a strap 28. The strap 28 connects to a buckle assembly 30. The outer portion of the buckle assembly 30 connects to a vest 32. The buckle 30 provides for longitudinal adjustment of the strap 38 so as to vary the distance the vest 32 is from the waist pack 20. The reason for the buckle 30 is so as to accommodate to different heights of humans 10 that are to wear the vest 32.

The vest 32 is to be constructed of one or more internal chambers 34. The material of construction of the vest 32 is so that it can retain a pressurized gas such as air within the chamber 34. The gas is to be supplyable from a source such as a small cartridge 46 which is fixedly mounted by clamp 47 onto the vest 32. The cartridge 46 connects to a valve unit 48 which is deemed to be conventional. The valve unit 48 is to be openable upon a sufficient manual outward movement being imparted to lanyard 50 which connects to the valve unit 48. The outer end of lanyard 50 is connected to a handle 52. This handle 52 is to be located exteriorly of the waist pack 20 when the waist pack 20 is in the closed position, as shown in FIG. 2.

Let it be assumed that the human 10 wishes to utilize the vest 32. The human 10 takes one of his hands 54 and grabs handle 52 and exerts an outward jerking motion on the lanyard 50 which causes the valve unit 48 to be opened. Gas from the cartridge 46 is conducted within and fills the internal chamber 34 inflating the vest 32. In the short period of time that the inflation of the vest 32 occurs, this inflation procedure will apply pressure against the flap 24 disengaging the strip 26 from the strip 22 permitting the flap 24 to move to the open position shown in FIG. 1. This will permit the vest 32 to be moved exteriorly of the interior compartment 25 and the waist pack 20 substantially to the position shown in FIG. 1. It is important to note that the vest 32 is still tethered to the waist pack 20 by means of the strap 28 and the buckle 30.

When the vest 32 is inflated, the head 44 of the human is to be placed through opening 40 of the vest 32. This will cause the front portion of the vest 32 to be located against the chest area of the human, with the rear portion of the vest 30 to be located against the back of the neck 42. It is desirable to have the back portion of the vest 32 to be located against the back of the neck 42, rather than located against the back of the head. In order to achieve this end result the back portion of the vest should deflect so that the back portion of the vest 32 will assume a substantially right angled configuration relative to the front portion of the vest. This particular angular relationship is shown in FIG. 4 of the drawing. This angular relationship is achieved by incorporating of seal sections 36 and 38 within the body of the vest 32. These seal sections 36 and 38 are strategically located so as to achieve the desired deflection of the upper end portion of the vest 32 relative to the main body of the vest 32.

It is to be understood that normally the operation of the handle 52 will only be in a situation of dire emergency. Once the handle 52 is operated and the cartridge 46 emptied, the cartridge 46 must be replaced before the apparatus 18 of this invention could be reused. To avoid this replacement and operation during a non-emergency situation is desired, the user may inflate the vest 32 by using a conventional manual inflation tube assembly 56. It is to be understood that after inflation of the vest 32, whether manually or by means of the cartridge 46, that the pressurized gas contained within the internal chamber 34 can be expended from the chamber 34 through an appropriate outlet valve (not shown). Once the vest 32 has been expended of the pressurized gas within the chamber 34, it is capable of being folded into a collapsed state and reinserted back into the interior compartment 25 and the flap 24 again closed with strips 22 and 26 reengaging.

What is claimed is:

1. In combination with a waist pack adapted to be worn about the waist of a human, said waist pack having an interior compartment, a flap connected to said waist pack, said flap being movable between a closed position and an open position, said closed position closing said internal compartment to the ambient, said open position permitting access into said internal compartment, the improvement comprising:

an inflatable vest located in a non-inflated/collapsed configuration within said internal compartment and said flap closed;

a source of pressurized gas connected to said vest;

a valve connected to said source, said valve being normally closed preventing flow of gas from said source into said vest thereby preventing inflating of said vest, a manually engageable handle connected to said valve., upon sufficient movement of said manually engageable handle said valve being open permitting gas to flow from said source into said vest inflating said vest, said handle being located exteriorly of said waist pack when said vest is in said non-inflated/collapsed position and contained within said internal compartment and said flap closed;

a disengageable fastener being operated to maintain said flap in said closed position, upon sufficient movement of said manually engageable handle causing inflation of said vest said fastener being disengaged locating said flap in said open position permitting said vest to be moved exteriorly of said interior compartment;

a strap interconnecting said waist pack and said vest, thereby tethering said vest relative to said waist pack when said vest is located exteriorly of said interior compartment; and said strap including a buckle, said buckle permitting longitudinal adjustment of said strap.

2. The combination as defined in claim 1 wherein:

said source of pressurized gas being mounted on said vest.

3. In combination with a waist pack adapted to be worn about the waist of a human, said waist pack having an interior compartment, a flap connected to said waist pack, said flap being movable between a closed position and an open position, said closed position closing said internal compartment to the ambient, said open position permitting access into said internal compartment the improvement comprising:

an inflatable vest located in a non-inflated/collapsed configuration within said internal compartment and said flap closed;

a source of pressurized gas connected to said vest;

a valve connected to said source, said valve being normally closed preventing flow of gas from said source into said vest thereby preventing inflating of said vest, a manually engageable handle connected to said valve, upon sufficient movement of said manually engageable handle said valve being open permitting gas to flow from said source into said vest inflating said vest, said handle being located exteriorly of said waist pack when said vest is in said non-inflated/collapsed position and contained within said internal compartment and said flap closed; and said vest including an enlarged opening, said enlarged opening facilitating passage therethrough of a human head with said vest resting on the shoulders of the human, said vest including shaping means, said shaping means deflecting of the upper portion of the vest in an angular position away from the lower portion of said vest so as to position the upper portion of the vest directly behind the neck of the user.

4. In combination with a waist pack adapted to be worn about the waist of a human, said waist pack having an interior compartment, a flap connected to said waist pack, said flap being movable between a closed position and an open position, said closed position closing said internal compartment to the ambient, said open position permitting access into said internal compartment, the improvement comprising:

an inflatable vest located in a non-inflated/collapsed configuration within said internal compartment and said flap closed;

a source of pressurized gas connected to said vest;

a strap interconnecting said waist pack and said vest, thereby tethering said vest relative to said waist pack when said vest is located exteriorly of said interior compartment; and said strap including a buckle, said buckle permitting longitudinal adjustment of said strap.

5. The combination as defined in claim 4 wherein:

a valve connected to said source, said valve being normally closed preventing flow of gas from said source into said vest thereby preventing inflating of said vest, a manually engageable handle connected to said valve, upon sufficient movement of said manually engageable handle said valve being open permitting gas to flow from said source into said vest inflating said vest, said handle being located exteriorly of said waist pack when said vest is in said non-inflated/collapsed position and contained within said internal compartment and said flap closed.

* * * * *